US007861497B2

(12) United States Patent
Lardinois

(10) Patent No.: US 7,861,497 B2
(45) Date of Patent: Jan. 4, 2011

(54) BOX WRAPPING ASSEMBLY AND METHOD

(75) Inventor: Daniel M. Lardinois, Green Bay, WI (US)

(73) Assignee: Packaging Specialties, Inc., Germantown, WI (US)

( * ) Notice: Subject to any disclaimer, the term of this patent is extended or adjusted under 35 U.S.C. 154(b) by 183 days.

(21) Appl. No.: 12/345,847

(22) Filed: Dec. 30, 2008

(65) Prior Publication Data

US 2009/0188213 A1 Jul. 30, 2009

Related U.S. Application Data

(60) Provisional application No. 61/023,299, filed on Jan. 24, 2008.

(51) Int. Cl.
*B65B 11/04* (2006.01)

(52) U.S. Cl. ..... 53/399; 53/441; 53/449; 53/176; 53/556; 53/587

(58) Field of Classification Search ..... 53/399, 53/441, 449, 176, 556, 587
See application file for complete search history.

(56) References Cited

U.S. PATENT DOCUMENTS

| | | | | | |
|---|---|---|---|---|---|
| 3,796,339 | A | | 3/1974 | Suzuki | |
| 4,271,657 | A | * | 6/1981 | Lancaster et al. | 53/399 |
| 4,299,076 | A | * | 11/1981 | Humphrey | 53/587 |
| 4,300,326 | A | * | 11/1981 | Stackhouse | 53/587 |
| 4,432,185 | A | | 2/1984 | Geisinger | |
| 4,492,153 | A | | 1/1985 | Grabowski | |
| 4,563,863 | A | * | 1/1986 | Humphrey | 53/556 |
| 4,807,427 | A | | 2/1989 | Casteel et al. | |
| 4,845,920 | A | | 7/1989 | Lancaster | |
| 4,858,415 | A | * | 8/1989 | Hake | 53/441 |
| 4,969,567 | A | | 11/1990 | Rogers | |
| 5,005,335 | A | * | 4/1991 | Yourgalite et al. | 53/399 |
| 5,020,300 | A | * | 6/1991 | Casteel | 53/399 |
| 5,040,359 | A | * | 8/1991 | Thimon | 53/556 |
| D321,653 | S | | 11/1991 | Elgner | |
| 5,129,206 | A | | 7/1992 | Kidani et al. | |
| 5,138,818 | A | * | 8/1992 | Humphrey | 53/556 |
| 5,168,685 | A | | 12/1992 | Suzuki | |
| 5,175,014 | A | | 12/1992 | Brockwell et al. | |
| 5,212,933 | A | * | 5/1993 | Cere' | 53/556 |
| 5,282,346 | A | * | 2/1994 | Masuda et al. | 53/587 |
| 5,287,981 | A | | 2/1994 | Wheeler | |

(Continued)

FOREIGN PATENT DOCUMENTS

DE 3236029 C1 * 12/1983

(Continued)

*Primary Examiner*—Stephen F Gerrity
(74) *Attorney, Agent, or Firm*—Joseph S. Heino; Patrick M. Bergin

(57) ABSTRACT

A box wrapping assembly and method incorporates a framework having a special top hold-down platen that functions with a cooperating fixture that is affixed to a rotatable turntable. Using this assembly and method, the operator can place four sidewall panels in a self-positioning fixture and panel-capturing platen prior to wrapping. Stretch film is connected to the fixture by a hook device and the stretch film is automatically pre-stretched to a rope of stretched film for particular application where the box contents are intended to be contained within the box under pressure.

17 Claims, 7 Drawing Sheets

U.S. PATENT DOCUMENTS

| | | | | | |
|---|---|---|---|---|---|
| 5,447,009 | A | | 9/1995 | Oleksy et al. | |
| 5,450,965 | A | | 9/1995 | Cox | |
| 5,463,843 | A | | 11/1995 | Sharp | |
| 5,491,956 | A | * | 2/1996 | Donnelly et al. | 53/399 |
| 5,522,203 | A | * | 6/1996 | Lancaster et al. | 53/441 |
| 5,749,204 | A | | 5/1998 | Bokelmann et al. | |
| 5,893,258 | A | * | 4/1999 | Lancaster, III | 53/399 |
| 6,047,523 | A | * | 4/2000 | Eyre et al. | 53/399 |
| 6,065,269 | A | * | 5/2000 | Malnati | 53/176 |
| 6,550,222 | B2 | * | 4/2003 | DeGrasse | 53/399 |
| 6,796,105 | B2 | | 9/2004 | Rossi | |
| 6,971,220 | B1 | | 12/2005 | Rampp | |
| 7,114,308 | B2 | * | 10/2006 | Cox | 53/399 |

FOREIGN PATENT DOCUMENTS

| | | | | |
|---|---|---|---|---|
| FR | 2622866 | A1 | * | 5/1989 |
| GB | 2192853 | A | * | 1/1988 |
| JP | 52017991 | A | * | 2/1977 |
| JP | 01009105 | A | * | 1/1989 |
| JP | 06099918 | A | * | 4/1994 |
| WO | WO 9207761 | A1 | * | 5/1992 |
| WO | WO 2005/025992 | | | 3/2005 |
| WO | WO 2007/100597 | | | 9/2007 |

* cited by examiner

FIG. 4
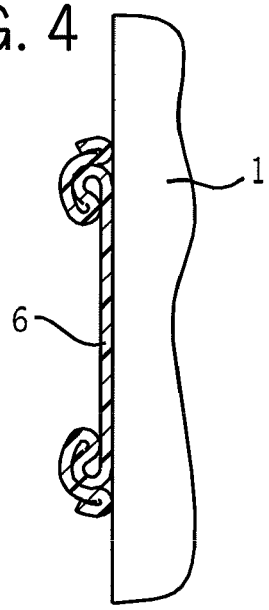
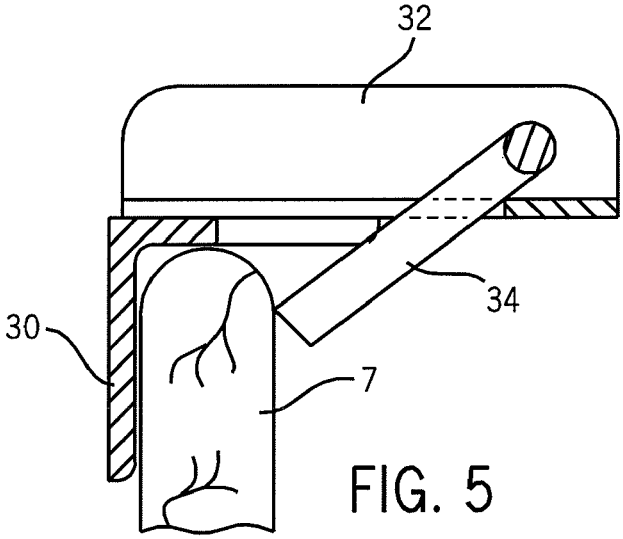
FIG. 5
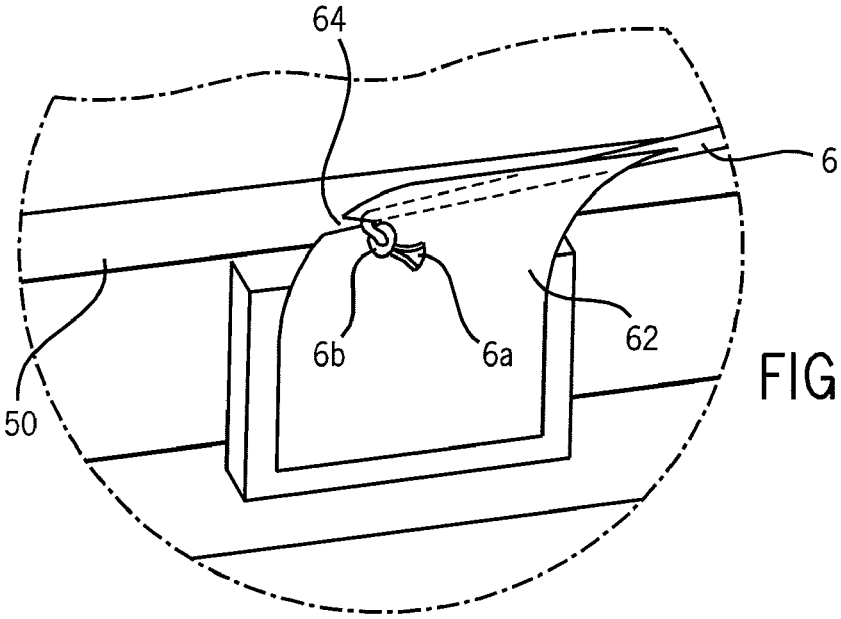
FIG. 6
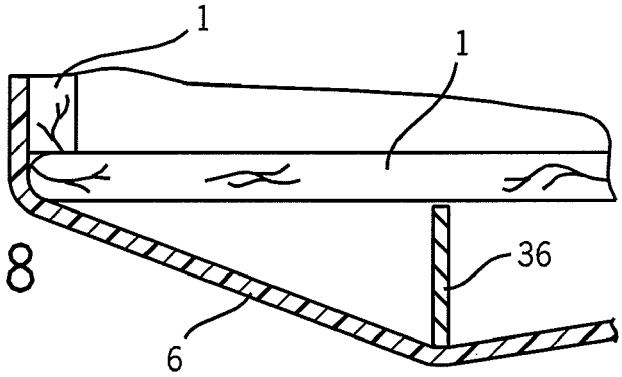
FIG. 8

BOX WRAPPING ASSEMBLY AND METHOD

This application claims the benefit and priority of U.S. Provisional Patent Application No. 61/023,299 filed Jan. 24, 2008.

FIELD OF THE INVENTION

This invention relates generally to the field of machines, assemblies and methods that are used in the packaging industry. More specifically, it relates to an assembly and method for wrapping a box or other item with a roped plastic film.

BACKGROUND OF THE INVENTION

In the field of packaging, the use of plastic film to wrap palletized loads is well known in the art. Various assemblies and methods have been previously devised to dispense a plastic film from a film roll and place the film around the load. Doing so adds to the overall strength to the binding of the load and allows the load to be impervious to outside environmental conditions, including moisture, dirt, and the like.

By way of one particular application, which application is not a limitation of the present invention, it is also well known in the cheese making arts that a cheese box can be assembled manually by an operator for use in the cheese-making process. This type of cheese box is typically comprised of four like-sized and wax-coated, wooden panels that connect with one another at the corners by way of interlocking and/or dove tail tabs. Angle iron pieces, disposed vertically at the box corners, are used for added support of the box. In this process, the operator affixes four such freshly-painted and wax-coated angle iron pieces to each corner of the box. The operator then wraps the four wooden panels of the box, together with the angle iron pieces, with metal banding in several locations to hold the box together. After this portion of the box is assembled and is filled with a semi-liquid cheese, a bottom and spring-loaded top are similarly banded to the box and the contents are compressed under pressure to extract moisture from the semi-liquid cheese. The box is then put into storage for the cheese aging process, which varies depending upon the type of cheese that is being made. After the cheese aging process is completed, the box is disassembled to remove the aged cheese and the four wooden panels and four angle iron corners are returned to a facility where the wooden panels and angle irons are recycled. Specifically, the wooden panels are stripped and recoated with fresh wax and the angle irons are similarly stripped, repainted and re-waxed.

In the art of box wrapping, it would be desirable to provide a new and useful box wrapping assembly and method whereby the use of metal banding can be eliminated and the use of angle iron corners can be eliminated as well. In the specific application mentioned above, an additional concern is that paint can chip away from the angle iron corners and contaminate the bulk cheese product. Elimination of the angle iron corners eliminates this type of product contamination. Additionally, it would desirable that the metal banding be replaced by roped plastic film wrap that can be positioned about the box such that a sufficient amount of moisture is allowed to flow out of the box, another particular concern in the cheese making industry for reasons mentioned above. It would also be desirable to provide such an assembly and method whereby the leading edge of the roped plastic film wrap can be quickly and easily anchored to a member at which point the box wrapping method would be initiated by an operator. It would also be desirable to provide a mechanism for allowing the trailing edge of the roped plastic film wrap to be cut and easily inserted under another portion of the roped plastic film wrap such that the trailing edge is adequately captured and held in place to complete the wrapping process.

SUMMARY OF THE INVENTION

The box wrapping assembly and method of the present invention has obtained these objects. It provides for an assembly and method whereby the assembly incorporates a framework having a special top hold-down platen that functions with a cooperating fixture that is affixed to a turntable. This arrangement allows the operator to place the four wooden panels in a self-positioning fixture and panel-capturing platen. Once the panels are in place, the stretch film is connected to the fixture by means of a hook device that is incorporated into the bottom fixture and the stretch film is automatically pre-stretched at a very high rate and formed (by way of custom roping rollers) to a rope of stretch film. Pre-stretching of the film into a rope is particularly useful where the intent is to maintain the contents of the box under pressure. The rope of stretch film is then applied by way of a custom machine program at the same locations as are presently occupied by the steel bands. This effectively eliminates the need for the angle iron corners which reduces assembly time, materials and transportation costs. The roped and stretched plastic film is extremely strong and it is applied in the same locations, but which are fully adjustable depending upon the specific application, as the metal bands would be. Additionally, the roped film is controlled with regard to how many turntable revolutions of each of the several "banded" sections are required. The assembly of the present invention uses a high speed turntable to achieve a cycle rate of under one minute. The cost of the plastic film is roughly one-third the price of metal bands which is also a significant material cost reduction, and is recyclable. The transportation costs associated with shipping the angle iron pieces, stripping, painting and re-waxing them effectively goes away with the assembly and method of the present invention.

The foregoing and other features of the present invention will be apparent from the detailed description that follows.

BRIEF DESCRIPTION OF THE DRAWINGS

FIG. 4 is a greatly enlarged cross-sectional view of the roped plastic film taken along line 4-4 in FIG. 3.

FIG. 5 is a greatly enlarged cross-sectional view of the locking mechanism used to capture the top portion of a panel by the platen as taken along line 5-5 in FIG. 3.

FIG. 6 is a greatly enlarged view of the film rope catch device taken along line 6-6 in FIG. 3.

FIG. 8 is a greatly enlarged top plan and cross-section view taken along line 8-8 in FIG. 7.

DETAILED DESCRIPTION

Figure 1:
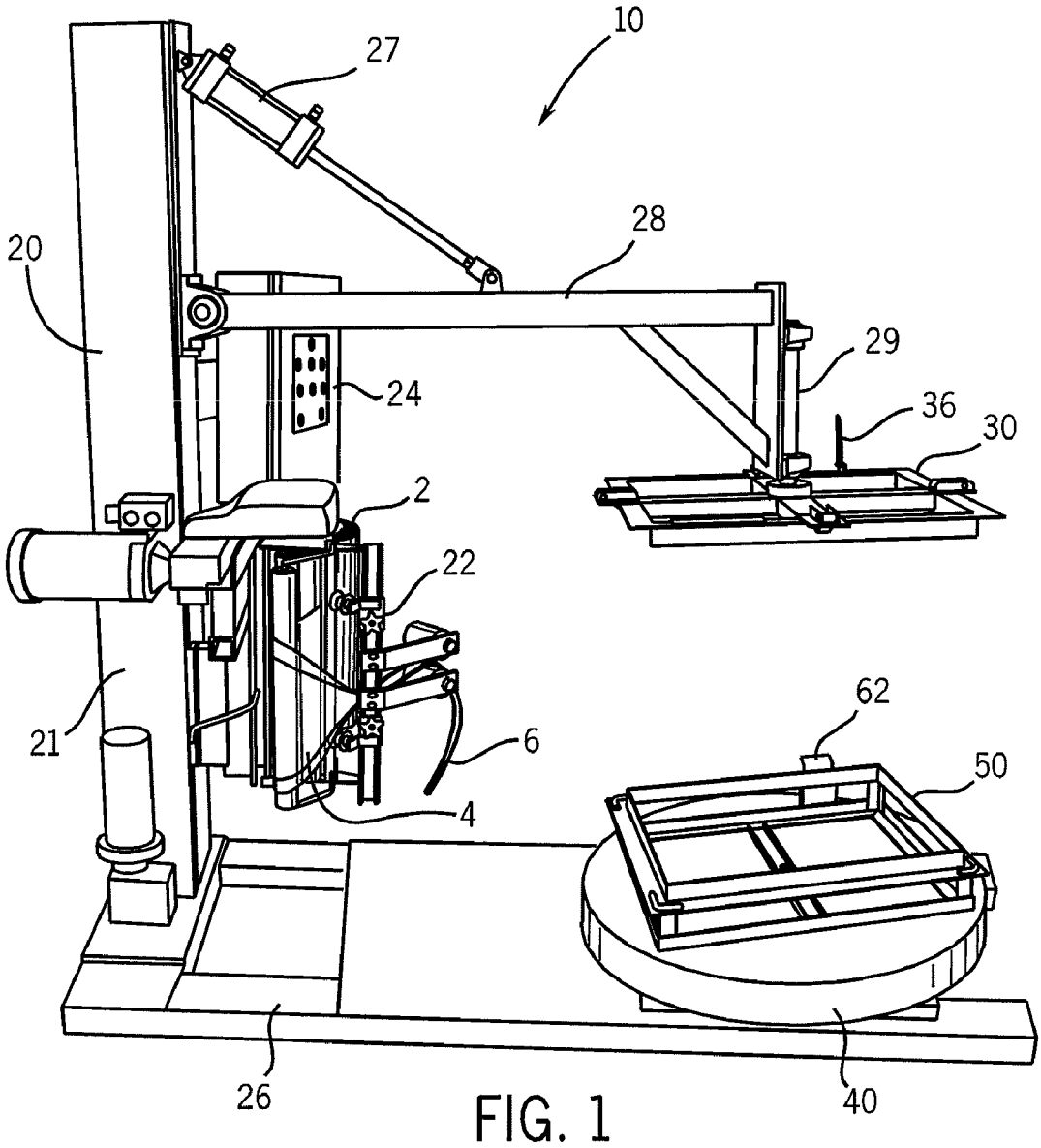
FIG. 1 is a front perspective view of a box wrapping assembly that is constructed in accordance with the present invention.

Referring now to the drawings in detail wherein like numbers represent like elements throughout, FIG. 1 illustrates a perspective view of one embodiment of the box wrapping assembly, generally identified 10, the assembly 10 being constructed in accordance with the present invention. It is to be understood that other embodiments could be devised within the scope of the present invention and that the embodiment described here is for purposes of illustrating enablement of the invention.

As shown, the assembly 10 comprises a frame 20 having an upright column 21 that is supported by a substantially horizontal base portion 26. The base portion 26 also includes a rotating table 40. A fixture 50 is located atop the rotating table 40. The upright support column 21 of the frame 20 also includes a cantilevered arm 28, the position of the cantilevered arm 28 being actuated by means of a pneumatic air cylinder 27. At the distal end of the cantilevered arm 28 is a downwardly extending rotational support 29 to which is attached a platen 30.

The assembly 10 also includes a film wrap dispensing mechanism 22, the film wrap dispensing mechanism 22 being capable of feeding roped plastic film 6 from a continuous plastic sheet 4 that is unwound from a plastic film roll 2. The film dispensing mechanism 22 is used to automatically pre-stretch at a very high rate and form the film sheet 4 into a film rope 6. The rope 6 of stretched film 4 is extremely strong because the film 4 is pre-stretched to its close to maximum level of tension thereby reducing and holding to a minimum its ability to stretch any further. Operation of the film dispensing mechanism 22 and movement of the cantilevered arm and rotating table are all controlled by means of a programmable logic controller 24, or "PLC."

Figure 2:
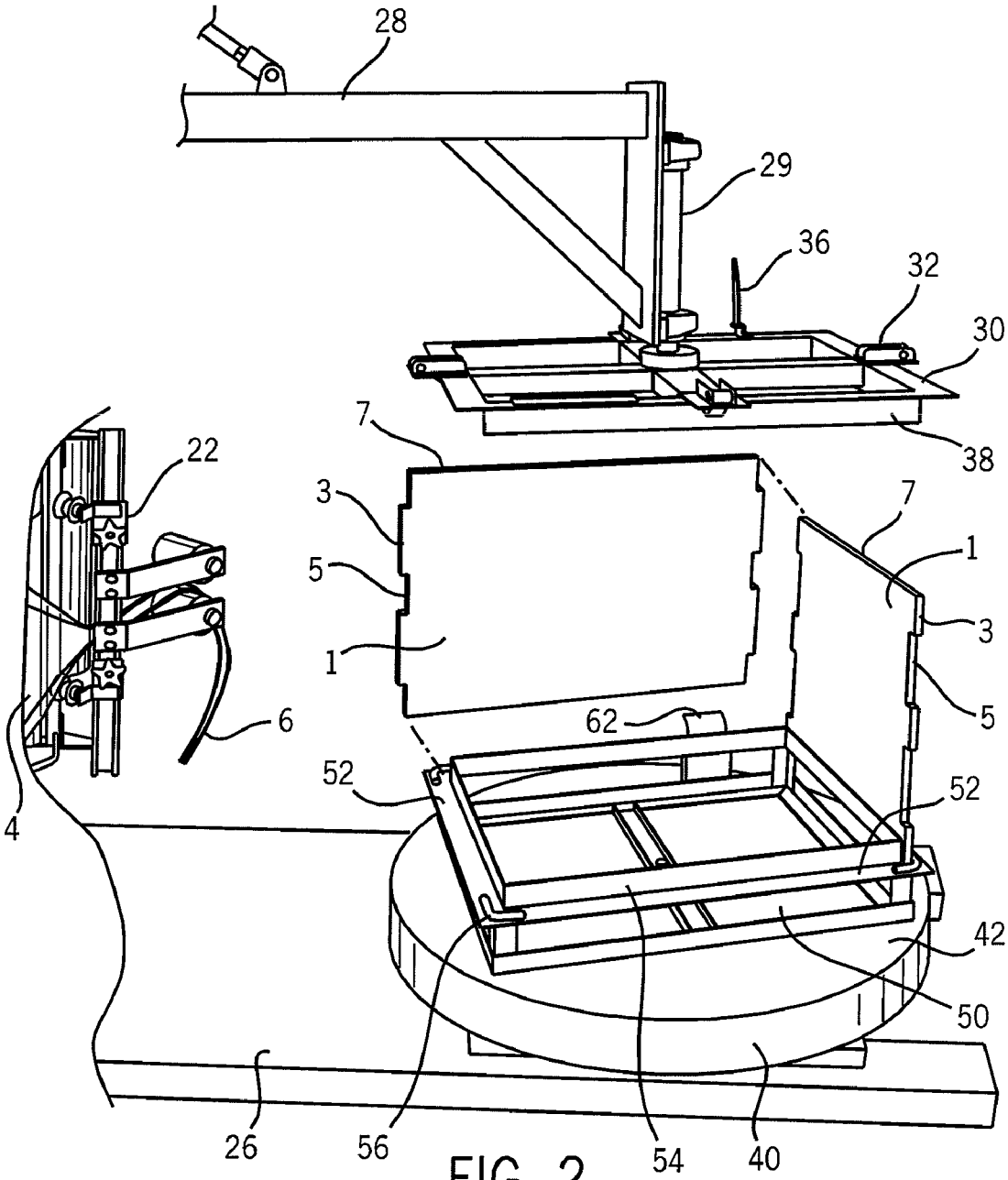
FIG. 2 is a slightly enlarged partial view similar to that shown in FIG. 1 and illustrating the positioning of box sidewalls within the assembly in accordance with the present invention.

Referring now to FIG. 2, it will be seen that the rotating base 40 that sits atop the base portion 26 of the frame 20 includes a top surface 42 upon which the fixture 50 is affixed. The fixture 50 includes a top surface 52 from which four upwardly disposed planar members 54 extend. At each corner at which the upright members 54 intersect, a corner support member 56 is also located atop the fixture surface 52, the support members 56 being positioned away from the upright members 54 by the approximate dimension of the thickness of a panel or sidewall 1 that would be used to form a box. Specifically, the space that is defined between the corner support members 56 and the upright members 54 are used to position a wooden sidewall 1 within them, in this preferred embodiment. It is to be understood that sidewalls fabricated from other materials could be used without deviating from the scope of the present invention. It is also to be understood that the fixture 50 could be configured from a plurality of separately-positioned corner members (not shown) that, together, perform the panel-capturing functionality that is described above.

As shown, each wooden sidewall 1 includes an upper edge 7 and a plurality of tabs 3 and recesses 5, the tabs 3 and recesses 5 being configured to interlock with like tabs 3 and recesses 5 of adjoining sidewalls 1. As shown in FIG. 5, it will be seen that each sidewall upper edge 7 is captured by means of a pivotable drop down lock member 34 that extends downwardly from a support member 32, each support member 32 being fixedly secured to the platen 30. The downwardly extending lock member 34 of each support member 32 is intended to capture the upper edge 7 of a single sidewall 1 as it is placed into position by the operator.

As is also shown in FIG. 2, the platen 30 is positionable above the fixture 50 in such a way that an inner edge 38 of the platen 30 is aligned vertically with the upright members 54 of the fixture. This allows proper alignment and positioning of the box sidewalls 1 during assembly.

It should also be understood that, as the fixture 50 is allowed to rotate, the platen 30 will also rotate with it when the first sidewall 1 is properly positioned between the fixture 50 and the platen 30. This allows the fixture 50 and platen 30 to be indexed by 90° and at a timed interval such that the operator has adequate time to place each sidewall 1 without the need for the operator to manually rotate the fixture 50, although such could be done if desired or required by the particular application. In other words, this may be a controlled function initiated by the PLC 24 or a manually-initiated action.

Figure 3:
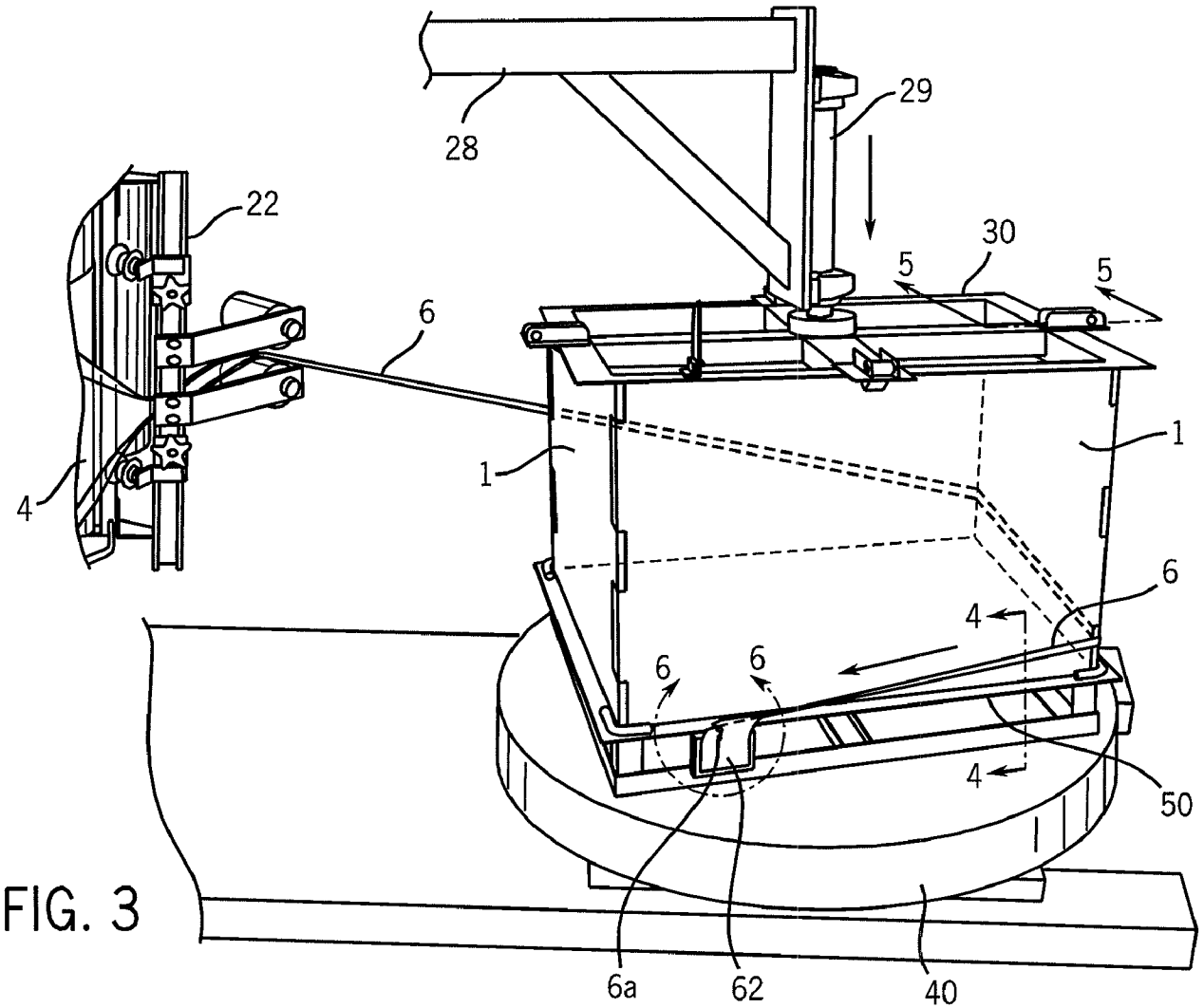
FIG. 3 is a view similar to that shown in FIG. 2 and illustrating the box sidewalls as captured within the assembly in accordance with the present invention.

Referring now to FIGS. 3 and 6, it will be seen that a film capturing device 62 is attached to a point on the fixture 50. The film capturing device 62 is shown in the preferred embodiment to be an outwardly curved member having a slot 64 defined in it. The slot 64 is used by the operator to "capture" the leading edge 6a of the roped plastic film 6. This is accomplished by the operator quickly tying the leading edge 6a of the film 6 into a knot 6b. With the knot 6b captured within the slot 64, rotation of the table 40 can be started. Here again, this may be a controlled function initiated by the PLC 24 or a manually-initiated action.

Figure 7:
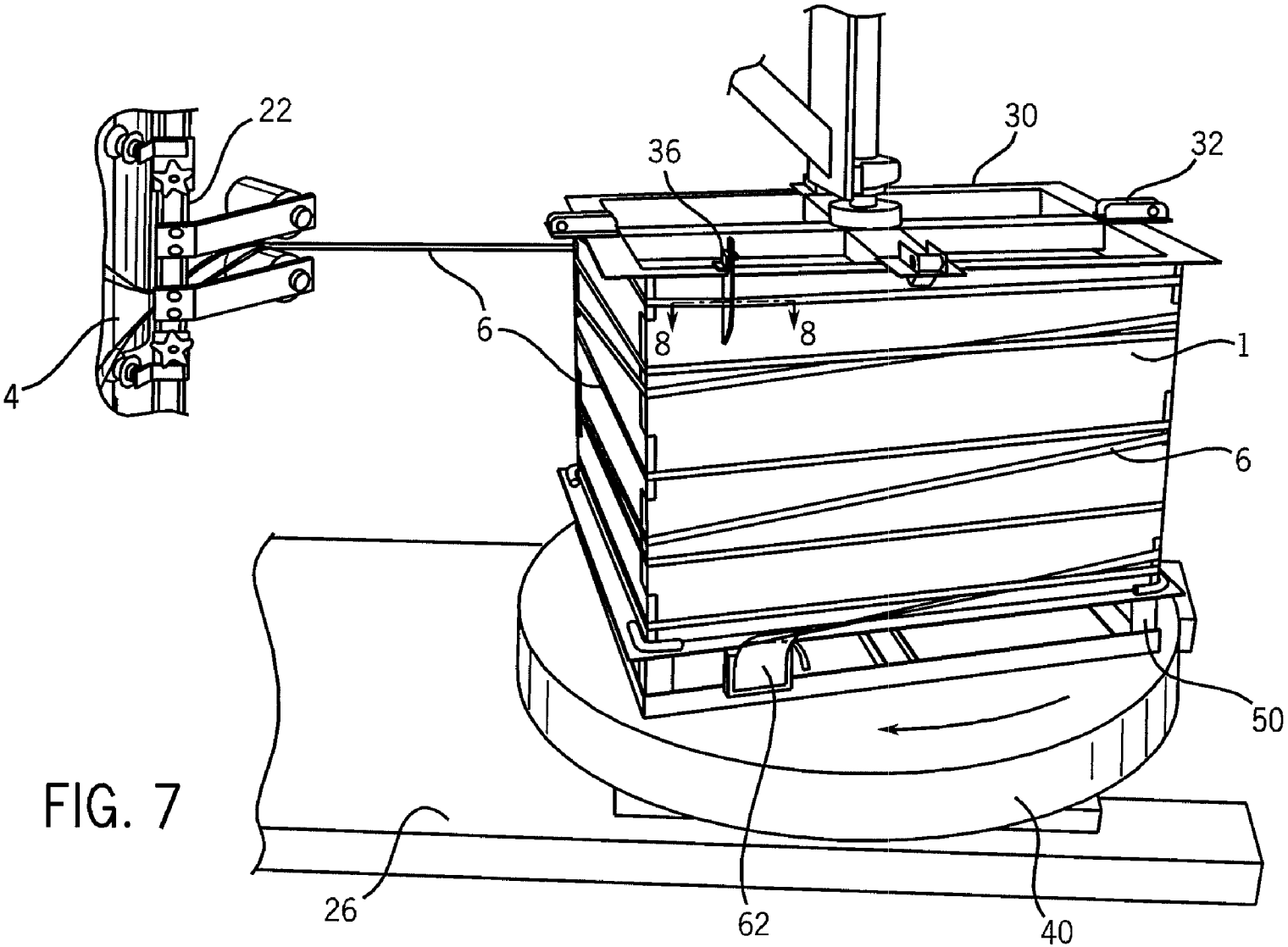
FIG. 7 is a view similar to that shown in FIGS. 2 and 3 and illustrating the box sidewalls as being wrapped in accordance with the present invention.
Figure 9:
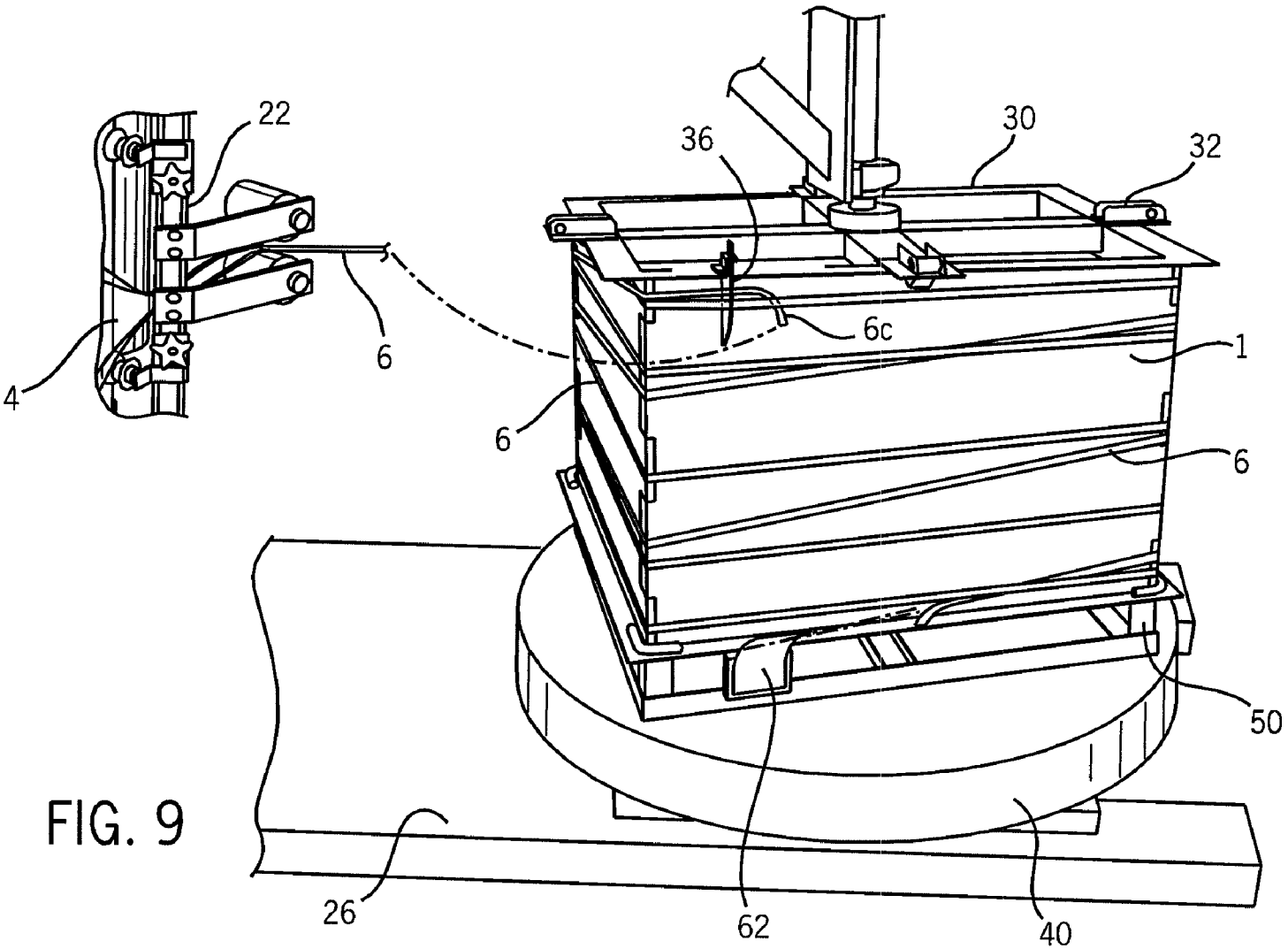
FIG. 9 is a view similar to that shown in FIGS. 2, 3 and 7 and showing the capture of the trailing edge of the roped plastic film wrap.

In accordance with the assembly 10 and method of the present invention, the table 40 rotates at a given speed dictated by the PLC 24 as programmed, or pre-programmed, for the specific application. As the table 40 rotates, the PLC 24 is also used to control the vertical indexing of the plastic film wrap dispensing mechanism 22 along the upright support column 21. The PLC 24 may be programmed to index vertically following several rotations of the table 40 at one set vertical position. See FIG. 7. The placement of the roped film 6 and an exemplary cross-sectional profile is illustrated in FIG. 4 as well, it being understood that the roped film 6 could have other cross-sectioned profiles that are intended to be fully within the scope of the present invention.

As the PLC 24 nears the end of the cycle for wrapping the sidewalls 1, the uppermost bands of roped film 6 are also urged outwardly and away from one of the sidewalls 1 by means of a spacer 36. See FIGS. 7 and 8. At the end of the wrapping cycle, the trailing edge 6*c* of the roped plastic film wrap 6 can be cut by the operator and tucked under that portion of the roped film 6 that is pushed outwardly from the sidewall 1. The assembly 10 is then actuated such that the cantilevered arm 28, the platen 30 and the spacer 36 are raised such that the portion of the roped film 6 adjacent the spacer 36 slides down along the spacer 36 and the trailing edge 6*c* of the roped plastic film wrap 6 is captured under that portion of the roped film 6. Wrapping is completed and the wrap dispensing mechanism 22 can be indexed downwardly to begin a new wrapping cycle.

Figure 10:
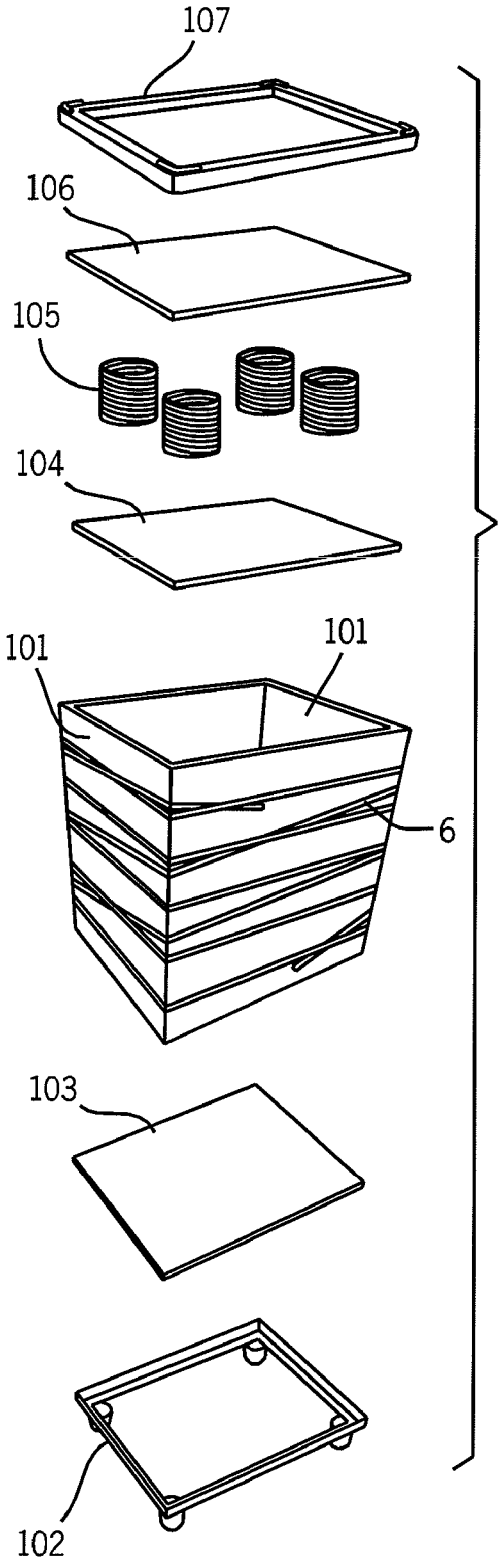
FIG. 10 is an exploded view of a box that is constructed in accordance with the present invention as it would be used with a cheese product.
Figure 11:
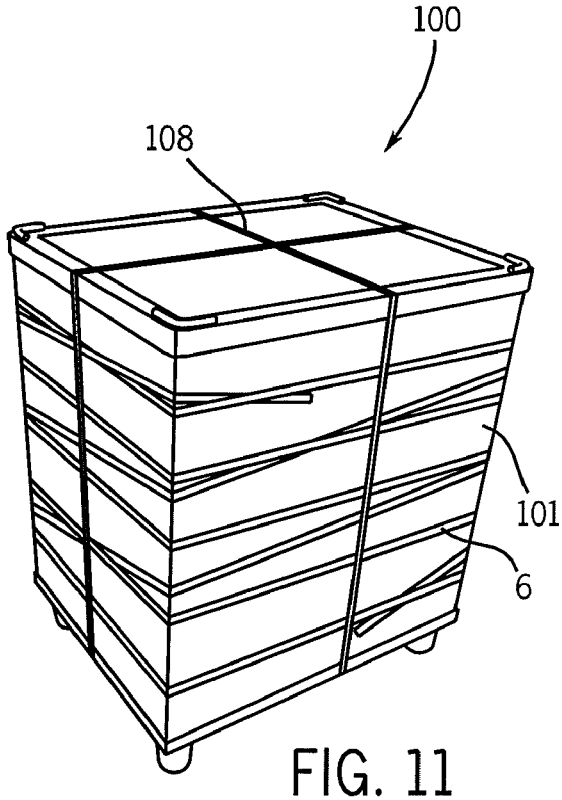
FIG. 11 is the completed box shown in FIG. 10 following assembly.

In the specific application referred to earlier, which application is not a limitation of the present invention, a cheese box, generally identified 100, can be assembled by an operator for use in the cheese-making process. See FIGS. 10 and 11. This type of cheese box 100 is typically comprised of four like-sized and wax-coated, wooden panels 101 that connect with one another at the corners by way of interlocking and/or dove tail tabs. Using the assembly 10 and method of the present invention, the side panels 101 would be wrapped as described above. The wrapped sidewalls 101 would sit atop a floor panel 103 and a footing 102. On top of the cheese product (not shown) that would be placed within the sidewalls 101 and floor panel 103 would be a first top panel 104, a plurality of springs 105, a second top panel 106 and a top frame 107. Bands 108 would then be placed about the assembled box 100. Here again, this construction eliminates the use of angle iron pieces that would otherwise be disposed vertically at the box corners. The box 100 is then put into storage for the cheese aging process, which varies depending upon the type of cheese that is being made. After the cheese aging process is completed, the box 100 is disassembled to remove the aged cheese and the four wooden panels 101 are returned to a facility where they are stripped and recoated with fresh wax. The removed roped plastic film wrap 6 can be recycled as well.

Based upon the foregoing, it will be seen that there has been provided a new and useful box wrapping assembly and method whereby the assembly incorporates a framework having a special top hold-down platen that functions with a cooperating fixture that is affixed to a turntable. Using this assembly and method, the operator can place four sidewall panels in a self-positioning fixture and panel-capturing platen prior to wrapping. The stretch film is connected to the fixture by means of hook device and the stretch film is automatically pre-stretched to a rope of stretched film for particular application where the box contents are intended to be contained within the box under pressure.

The details of the invention having been disclosed in accordance with the foregoing, I claim:

1. A box wrapping assembly comprising
- a frame having a base portion and an upright column,
- a rotating table supported above the base portion of the frame,
- a fixture located atop the table,
- a cantilevered arm, the arm having a first end that is positionable above the table,
- a platen rotatably attached to the first end of the cantilevered arm,
- a film wrap dispensing mechanism, the mechanism comprising means for dispensing roped plastic film from a continuous plastic sheet as the sheet is unwound from a plastic film roll,
- means for capturing a knotted leading edge of the roped plastic film, and
- means for rotating the table,
- wherein the film wrap dispensing mechanism is used to pre-stretch and form the film sheet into a film rope about a plurality of box sides disposed between the fixture of the rotating table and the platen as the table and box sides are rotated.

2. The box wrapping assembly of claim 1 wherein the cantilevered arm comprises a second end, the second end of the cantilevered arm being rotatably attached to the upright column of the frame.

3. The box wrapping assembly of claim 2 further comprising means for rotating the cantilevered arm about the second end such that the first end of the cantilevered arm and the platen can be raised and lowered.

4. The box wrapping assembly of claim 1 wherein the table rotating means comprises a programmable logic controller.

5. The box wrapping assembly of claim 4 wherein the programmable logic controller comprises means for dispensing roped plastic film at different vertical positions about the box sides and in accordance with a pre-programmed scheme.

6. The box wrapping assembly of claim 1 wherein the fixture comprises means for positioning each box side relative to the table and relative to the other box sides.

7. The box wrapping assembly of claim 1 wherein the fixture comprises means for positioning the corners of adjacent box sides relative to the table.

8. A box wrapping assembly of claim 1 wherein each box side comprises an upper edge and wherein the platen comprises a plurality of drop down lock members, each lock member being functionally adapted to capture the upper edge of a box side therein.

9. The box wrapping assembly of claim 1 wherein the film means for capturing comprises a knot-capturing slot.

10. The box wrapping assembly of claim 1 further comprising a spacer disposed along the platen wherein a portion of roped film is held away from a box side such that a trailing edge of the roped plastic film can be captured thereunder when the platen is raised and the spacer is withdrawn.

11. A box wrapping method comprising the steps of
- providing a frame having a base portion and an upright column,
- providing a rotating table supported above the base portion of the frame,
- providing a fixture located atop the table,
- providing a cantilevered arm, the arm having a first end that is positionable above the table,
- providing a platen rotatably attached to the first end of the cantilevered arm,
- providing a film wrap dispensing mechanism, the mechanism comprising means for dispensing roped plastic film from a continuous plastic sheet as the sheet is unwound from a plastic film roll,
- providing means for capturing a knotted leading edge of the roped plastic film,
- capturing a knotted leading edge of the roped plastic film,
- providing means for rotating the table,
- rotating the table, and
- dispensing roped plastic film from the dispensing mechanism,
- wherein the film wrap dispensing mechanism forms a film rope about a plurality of box sides disposed between the fixture of the rotating table and the platen as the table and box sides are rotated.

12. The box wrapping method of claim 11 including the steps of
- providing a programmable logic controller, and
- dispensing the roped plastic film about the box sides in accordance with a pre-programmed scheme.

13. The box wrapping method of claim 12 wherein the film dispensing step comprises the step of dispensing the roped plastic film at different vertical positions about the box sides.

14. The box wrapping method of claim 11 wherein each box side comprises an upper box edge and comprising, prior to said table rotating step, the steps of
- indexing rotation of the table to a first position,
- aligning a first box side with the table fixture,
- providing a plurality of drop down lock members for capturing the upper edges of the box sides within the platen,
- capturing the upper edge of the first box side within one of the drop down lock members,
- indexing rotation of the table by 90° to align a second box side with the table fixture,
- capturing the upper edge of the second box side within one of the drop down members, indexing rotation of the table by another 90° to align a third box side with the table fixture, capturing the upper edge of the third box side within one of the drop down members, indexing rotation of the table by another 90° to align a fourth box side with the table fixture, and capturing the upper edge of the fourth box side within one of the drop down members.

15. The box wrapping method of claim 14 including the steps of providing a programmable logic controller, indexing rotation of the table by means of the programmable logic controller, and dispensing the roped plastic film about the box sides in accordance with a pre-programmed scheme.

16. The box wrapping method of claim 15 wherein the film dispensing step comprises the step of dispensing the roped plastic film at different vertical positions about the box sides.

17. The box wrapping method of claim 11 comprising the step of providing a spacer disposed along the platen wherein a portion of roped film is held away from a box side and, after the film dispensing step, the step of capturing a trailing edge of the roped plastic film thereunder when the platen is raised and the spacer is withdrawn.

* * * * *